US010961797B2

(12) United States Patent
von Gynz-Rekowski et al.

(10) Patent No.: US 10,961,797 B2
(45) Date of Patent: Mar. 30, 2021

(54) INTEGRATED MILLING AND PRODUCTION DEVICE

(71) Applicant: Workover Solutions, Inc., Houston, TX (US)

(72) Inventors: Gunther H H von Gynz-Rekowski, Montgomery, TX (US); Mark Joshua Miller, Valencia, PA (US); Kevin James Rudy, Houston, TX (US)

(73) Assignee: Workover Solutions, Inc., Houston, TX (US)

( * ) Notice: Subject to any disclaimer, the term of this patent is extended or adjusted under 35 U.S.C. 154(b) by 7 days.

(21) Appl. No.: 16/376,321

(22) Filed: Apr. 5, 2019

(65) Prior Publication Data

US 2020/0318451 A1 Oct. 8, 2020

(51) Int. Cl.
*E21B 33/134* (2006.01)
*E21B 29/00* (2006.01)

(52) U.S. Cl.
CPC ..... *E21B 29/00* (2013.01); *E21B 29/002* (2013.01); *E21B 33/134* (2013.01)

(58) Field of Classification Search
CPC ..... E21B 29/00; E21B 33/134
See application file for complete search history.

(56) References Cited

U.S. PATENT DOCUMENTS

| | | | | |
|---|---|---|---|---|
| 4,154,303 | A * | 5/1979 | Fournier | E21B 34/06 166/317 |
| 5,195,586 | A | 3/1993 | Gambertoglio | |
| 6,397,946 | B1 * | 6/2002 | Vail, III | E21B 33/16 166/250.01 |
| 9,863,213 | B1 | 1/2018 | Kellam et al. | |
| 10,006,261 | B2 | 6/2018 | Watson et al. | |
| 2003/0183388 | A1 * | 10/2003 | Toulouse | E21B 23/04 166/298 |
| 2004/0108142 | A1 * | 6/2004 | Vail, III | E21B 7/065 175/171 |
| 2008/0173453 | A1 | 7/2008 | Misselbrook | |
| 2012/0085548 | A1 | 4/2012 | Fleckenstein | |
| 2017/0247967 | A1 | 8/2017 | Fleischhacker et al. | |
| 2017/0321547 | A1 | 11/2017 | Enkababian et al. | |

OTHER PUBLICATIONS

International Search Report and Written Opinion dated Jun. 2, 2020, from Applicant's counterpart International Patent Application No. PCT/US2020/025446.

* cited by examiner

*Primary Examiner* — Silvana C Runyan
(74) *Attorney, Agent, or Firm* — Jones Walker LLP

(57) ABSTRACT

An integrated milling and production device. The device includes a production housing, a connector, a motor, and milling bit. The production housing has a central bore with at least one flapper valve pivotally disposed therein and an actuator. Upon completion of milling operations, the connector may be disengaged from the production housing. The production housing may be repositioned in the well. Activation of the actuator permanently opens the flapper valve to permit the flow of production up the production housing to the well surface. The actuator may be a piston.

14 Claims, 22 Drawing Sheets

INTEGRATED MILLING AND PRODUCTION DEVICE

DETAILED DESCRIPTION OF THE PREFERRED EMBODIMENTS

Figure 1:
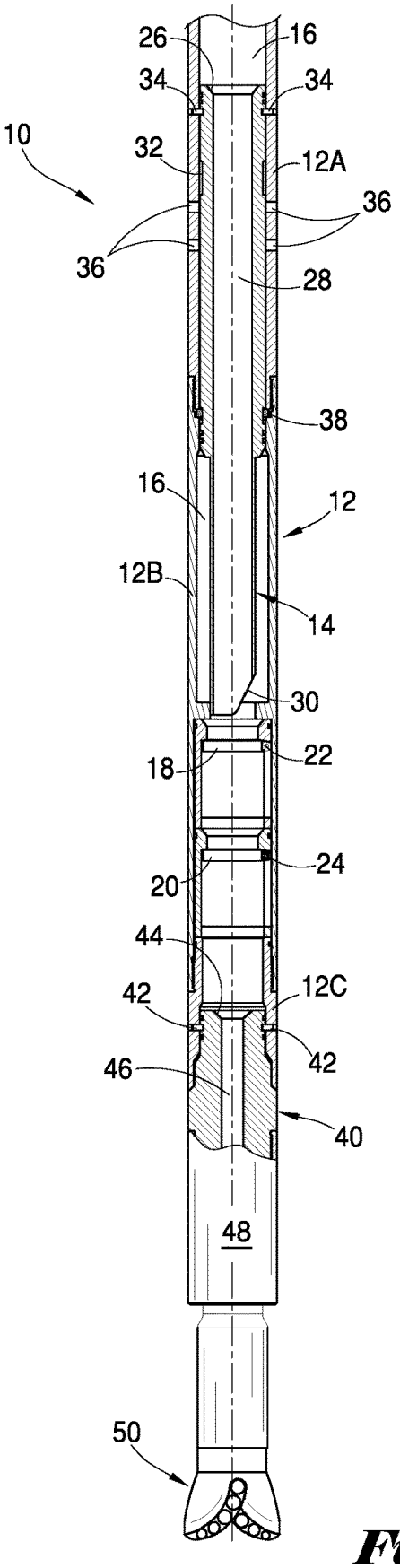
FIG. 1 is a partial sectional view of an integrated milling and production device.

An integrated milling and production device is designed to allow for production immediately following the milling of bridge plugs. In other words, there is no need to remove the tool used to mill the bridge plug from the wellbore or to run a separate production tool into the wellbore thereafter. Accordingly, the integrated milling and production device provides for both milling and production operations with only a single trip into the wellbore, thereby saving time and costs.

The integrated milling and production device may include an actuator disposed in a central bore of a production housing, one or more flapper valves pivotally disposed within the central bore of the production housing, a connector selectively secured below the production housing, and a motor and milling bit secured below the connector. The connector may be configured to disconnect from the production housing when activated. Thereafter, the cuttings from the bridge plug may be circulated out of the wellbore, and the integrated milling and production device may be transferred to a position within the wellbore that is downhole from a production zone. When activated, the connector will disconnect the connector, motor, and milling bit from the production housing. After disconnection, the connector, motor, and milling bit may remain in the downhole position while the production housing is transferred to an upstream position in the wellbore, such as to a production zone. The one or more flapper valves may remain closed until the actuator is activated, which sets the one or more flapper valves into an open position to allow production of a fluid from the wellbore below the production housing through the central bore of the production housing in an upstream direction. In one embodiment, the production housing includes one or more passages extending from its outer surface to the central bore. The one or more passages may remain closed until the actuator is activated, which opens the passages to allow production of a fluid from a subterranean formation surrounding the wellbore adjacent to the passages into the central bore of the production housing and upstream therethrough.

In one embodiment, the connector may include a seat surface configured to engage a ball traveling through the central bore of the production housing. Application of fluid pressure after the ball engages the seat surface may cause one or more shear pins securing the connector to the production housing above to be sheared, thereby disconnecting the connector from the production housing.

In one embodiment, the actuator may be a piston including a seat surface configured to engage a ball traveling through the central bore of the production housing. Application of fluid pressure after the ball engages the seat surface may cause one or more shear pins holding the piston in a milling position to be sheared, thereby allowing the piston to be displaced into a production position in which the one or more flapper valves are held in an open position and in which the one or more passages are open. The piston may be secured in the production position relative to the production housing by a locking mechanism. In one embodiment, the locking mechanism may include a snap ring that is secured within a space in an inner surface of the production housing in the milling position, and which is configured to move inwardly to engage a recess in an outer surface of the piston when it is displaced into the production position. In another embodiment, the locking mechanism may include a series of collets on the upper end of the piston, with the collets configured to engage a recess in an inner surface of the production housing when the piston is displaced into the production position. The ball engaging the seat surface of the piston may be configured to dissolve or otherwise break down within a predetermined time period of fluid exposure. Thereafter, a fluid below the seat surface of the piston may flow upstream through a central bore of the piston and the central bore of the production housing.

In another embodiment, an actuating fixture may transfer the piston from the milling position into the production position. The actuating fixture may be connected to an umbilical line for receiving a signal to slide the piston into the production position. Alternatively, the actuating fixture may include a sensor configured to detect the presence of one or more signal objects in proximity thereto, at which time the actuating fixture slides the piston into the production position.

Figure 2:
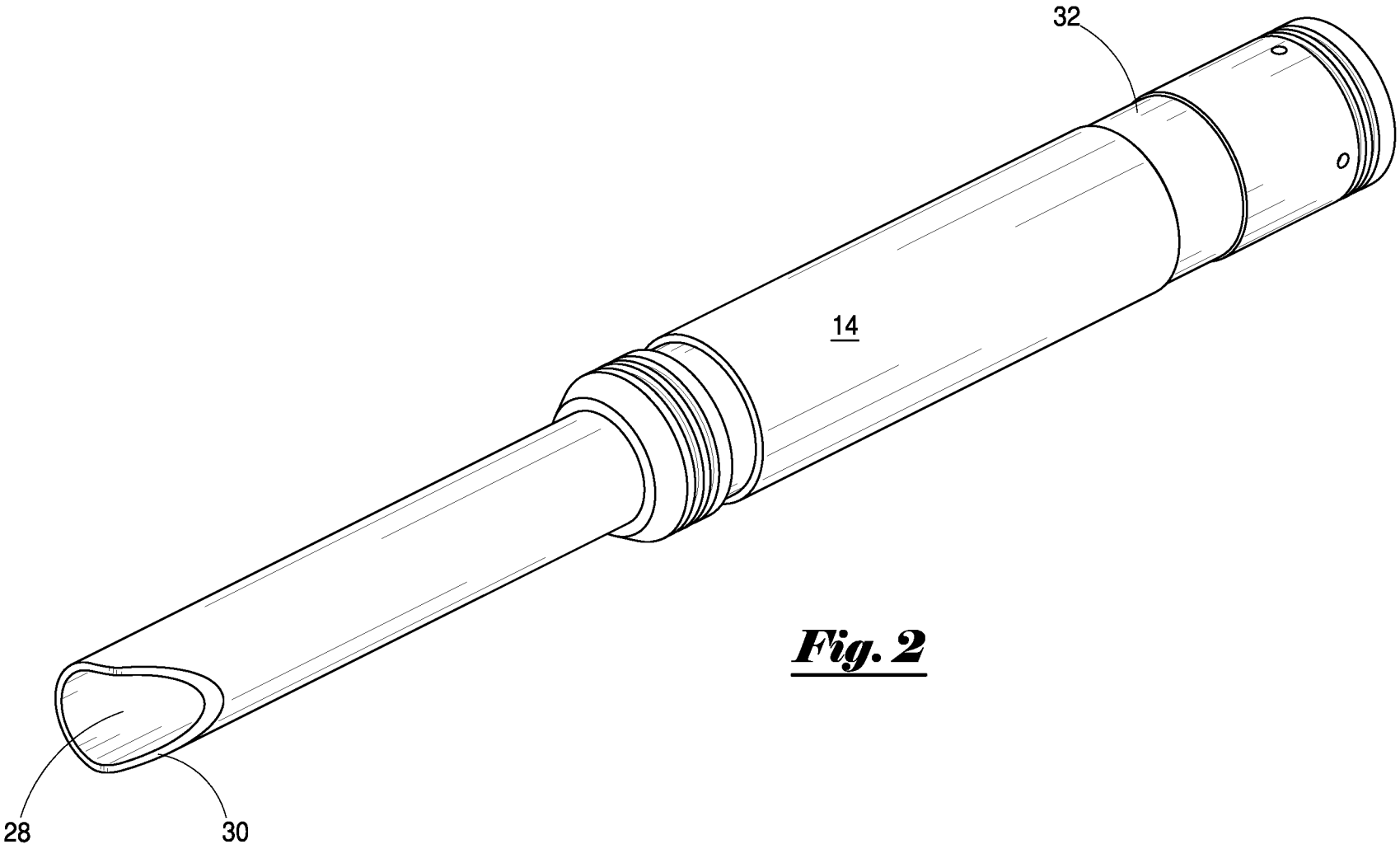
FIG. 2 is a partial perspective view of a lower end of a piston in the milling and production device.

With reference to FIG. 1, integrated milling and production device 10 may include production housing 12 formed of one or more segments, such as segments 12A, 12B, and 12C. The milling and production device 10 may also include piston 14 disposed within central bore 16 of production housing 12. One or more flapper valves may also be pivotally disposed within central bore 16 of production housing 12. For example, flapper valves 18 and 20 may be disposed within central bore 16 and configured for pivotal motion about pivot points 22 and 24, respectively. In one embodiment, each of flapper valves 18 and 20 is biased toward a closed position by a spring that engages the flapper valve. The flapper valves may be formed of steel or any other high strength material. In one embodiment, the flapper valves are rated for 10,000-15,000 psi. Piston 14 may include seat surface 26 at its upper end and piston central bore 28 extending from seat surface 26 to tapered lower end 30 (as shown in FIG. 2). The outer surface of piston 14 may include recess 32. FIG. 1 illustrates piston 14 secured in a milling position by shear pins 34, which are disposed through aligned recesses in production housing 12 and piston 14. In one embodiment, shear pins 34 may be formed of set screws. Production housing 12 may further include one or more passages 36 extending from an outer surface to central bore 16 of production housing 12. Snap ring 38 may also be positioned within a space within central bore 16 of production housing 12. Snap ring 38 may be formed of spring steel or any other metal capable of providing a spring loading function.

Referring again to FIG. 1, integrated milling and production device 10 may further include connector 40 selectively secured below production housing 12 by shear pins 42, which are disposed through aligned recesses in production housing 12 and connector 40. In one embodiment, shear pins 42 may be formed of set screws. Connector 40 may be attached to production housing 12 with a spline connection configured to transmit torque across the connection. Connector 40 may include seat surface 44 and central bore 46 extending from seat surface 44 to a lower end of connector 40. Seat surface 44 and central bore 46 have smaller diameters than piston central bore 28 and seat surface 26 of piston 14. Motor 48 and milling bit 50 may be secured below connector 40 as shown. Motor 48 may be configured to rotate milling bit 50 relative to connector 40. Milling bit 50 may be configured to mill bridge plugs within a wellbore. For example, milling bit 50 may be used to mill 1-100 bridge plugs in a wellbore, or any subrange therein.

Figure 3:
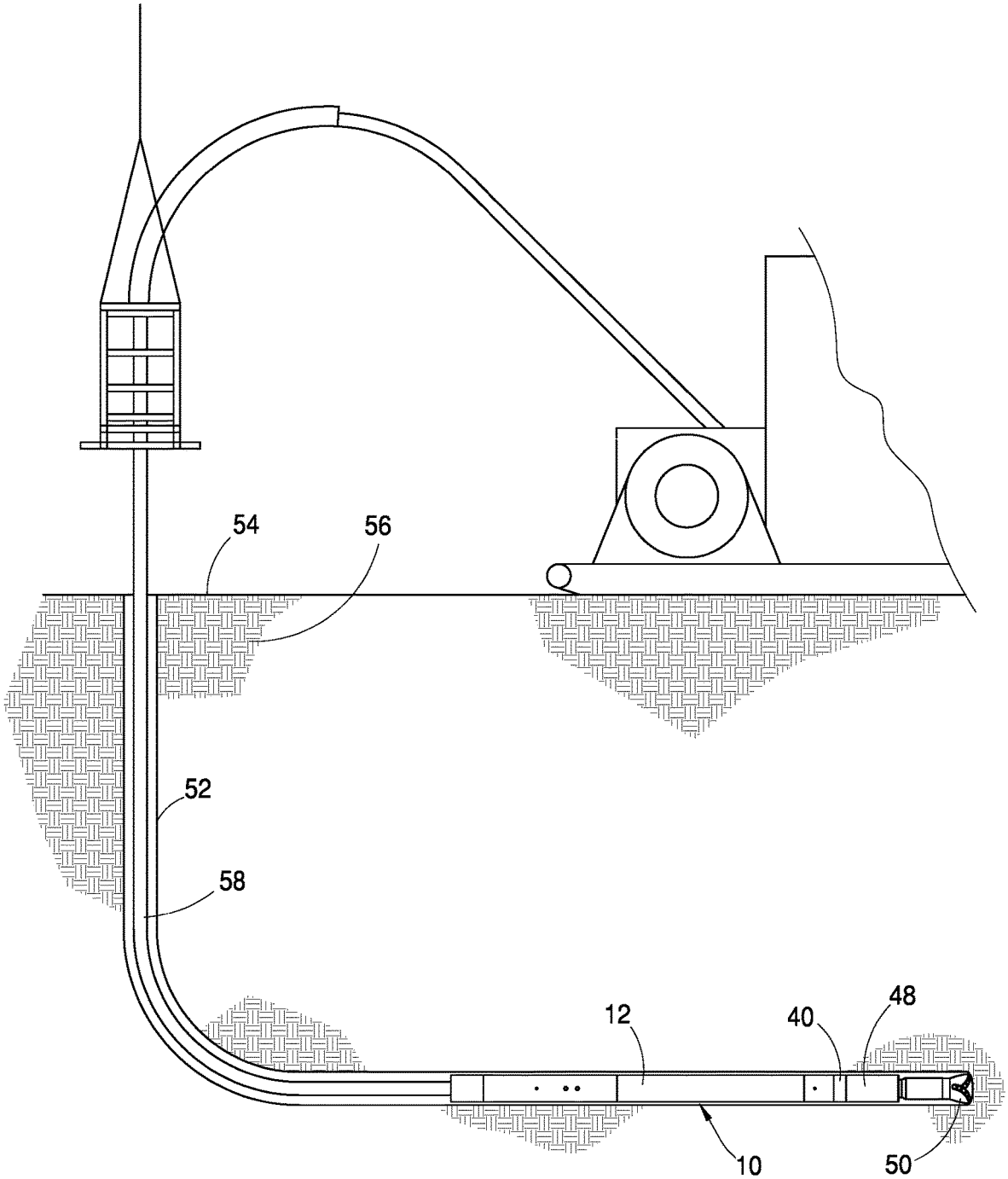
FIG. 3 is a schematic view of the milling and production device inserted into a wellbore through a subterranean formation with coiled tubing.
Figure 4:
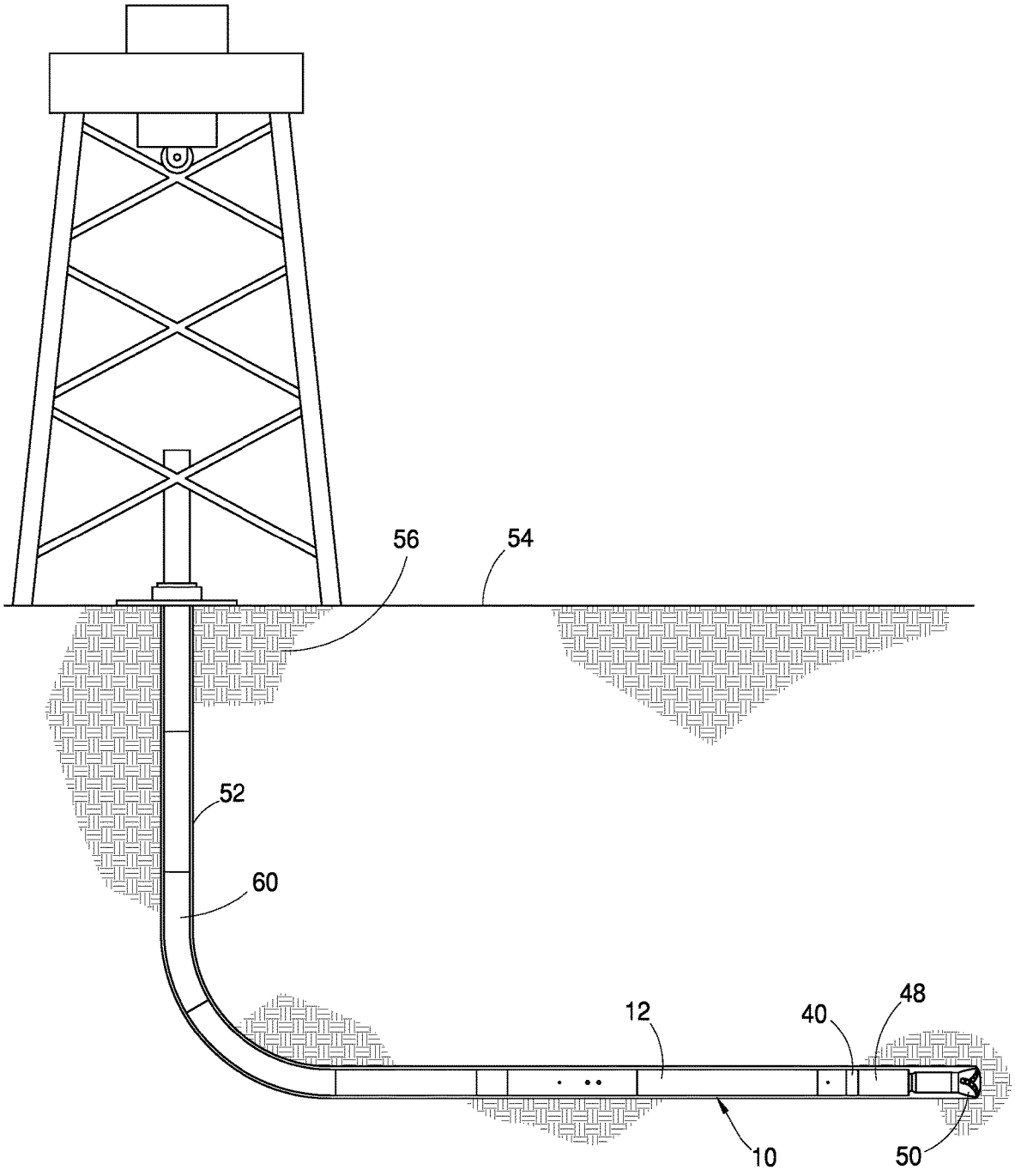
FIG. 4 is a schematic view of the milling and production device inserted into a wellbore through a subterranean formation with drill string.

With reference now to FIG. 3, integrated milling and production device 10 may be introduced into wellbore 52 below surface 54 in subterranean formation 56 using coiled tubing 58. Alternatively, as shown in FIG. 4, integrated milling and production device 10 may be introduced into wellbore 52 below surface 54 in subterranean formation 56 using drill string 60. In both processes, milling bit 50 may be used to mill one or more bridge plugs in wellbore 52 to prepare wellbore 52 for production. When milling operations are complete, integrated milling and production device 10 may be transferred to a downhole position within the wellbore.

Figure 5:
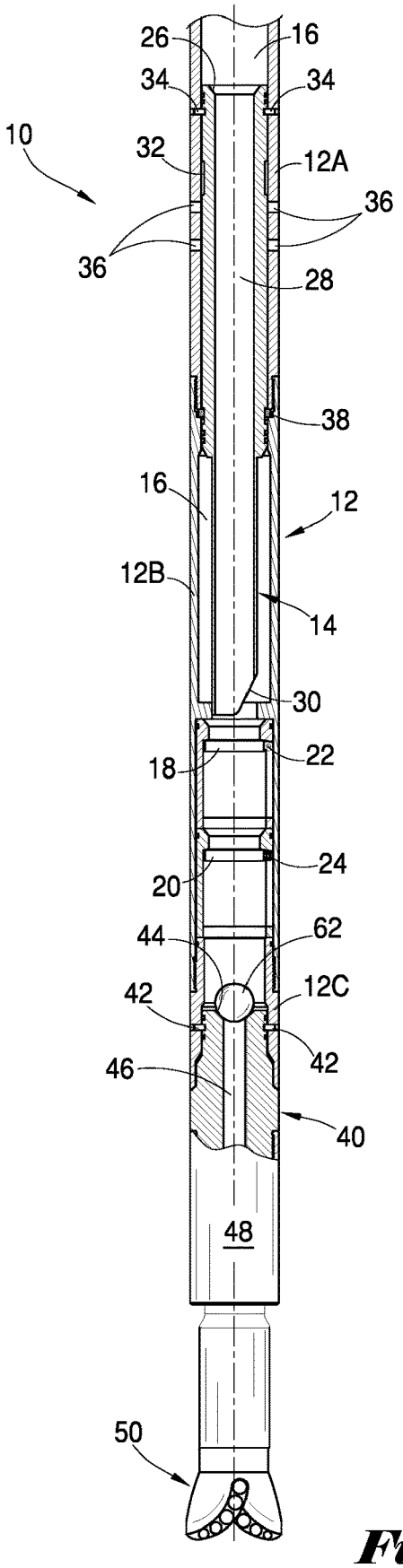
FIG. 5 is a partial sectional view of the milling and production device with a ball engaging a seat surface of a connector.
Figure 6:
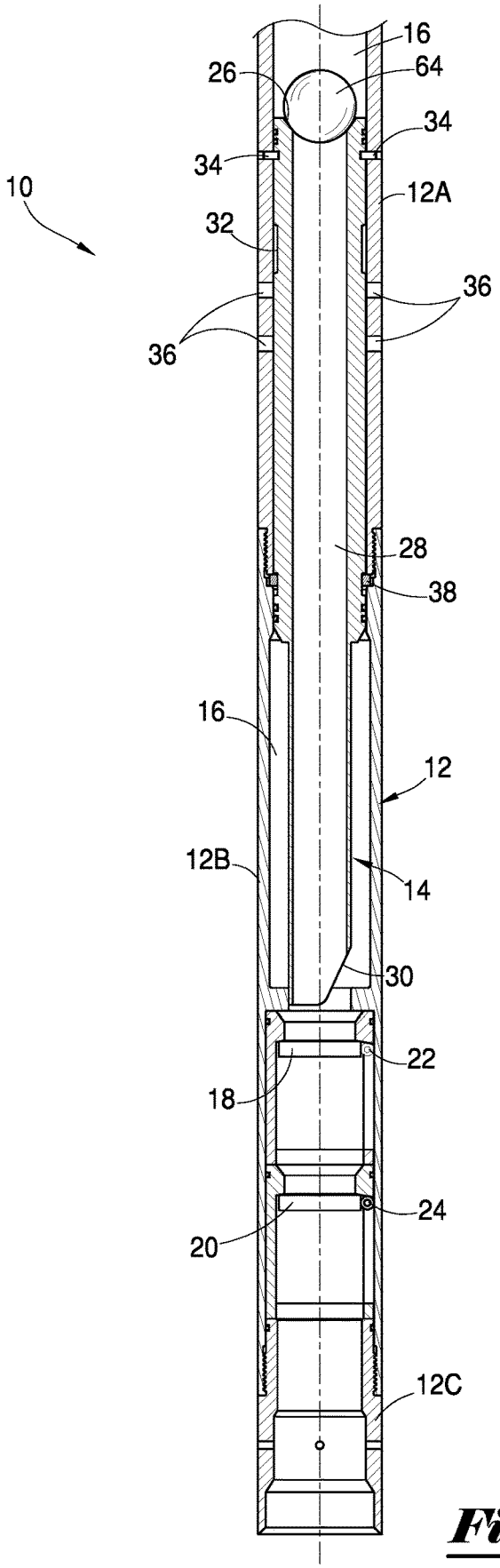
FIG. 6 is a sectional view of the milling and production device after the connector is activated by the ball, and with a ball engaging a seat surface of a piston.

Referring now to FIG. 5, with device 10 in the downhole position, a user may insert ball 62 from the surface through the coiled tubing 58 or drill string 60. Ball 62 may travel through central bore 16 of production housing 12, central bore 28 of piston 14, and flapper valves 18 and 20 before engaging seat surface 44 of connector 40. When ball 62 engages seat surface 44 of connector 40, ball 62 fluidly seals off central bore 46 of connector 40. Continued fluid flow into central bore 16 of production housing 12 builds pressure on ball 62 and the upper end of connector 40 until shear pins 42 are sheared, thereby disconnecting connector 40 from production housing 12 as shown in FIG. 6. For example, the fluid pressure may reach 3,000 to 5,000 psi before the shear pins are sheared. In this way, ball 62 may be used to activate connector 40 to disconnect connector 40 from production housing 12. Connector 40 along with motor 48 and milling bit 50 may remain in the downhole position within the wellbore while production housing 12 may be displaced upstream within the wellbore, thereby separating the respective portions of integrated milling and production device 10 without removing any portion of device 10 from the wellbore. Ball 62 may be formed of steel, of a ceramic material, of a rubber, or of a polymer.

With reference now to FIG. 6, flapper valves 18 and 20 may remain in the closed position as production housing 12 is repositioned within the wellbore. In this way, fluid in the wellbore is prevented from flowing upstream through central bore 16 of production housing 12 as long as piston 14 is in the illustrated milling position. Piston 14 may then be activated with ball 64. When production housing 12 is positioned in a production zone of the wellbore, a user may insert ball 64 from the surface through the coiled tubing 58 or drill string 60. Ball 64 may enter central bore 16 of production housing 12 and engage seat surface 26 of piston 14. When ball 64 engages seat surface 26 of piston 14, ball 64 fluidly seals off central bore 28 of piston 14. Continued fluid flow into central bore 16 of production housing 12 builds pressure on ball 64 and the upper end of piston 14 until shear pins 34 are sheared, thereby sliding piston 14 from the milling position shown in FIG. 6 to a production position shown in FIG. 7.

Figure 7:
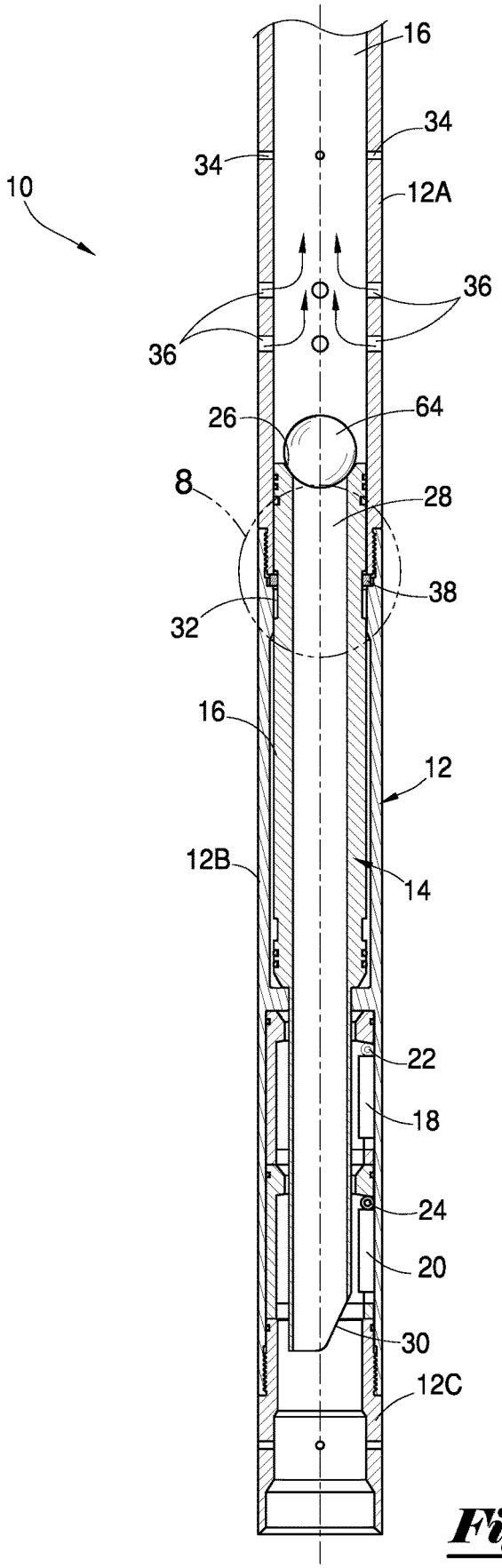
FIG. 7 is a sectional view of the milling and production device with the piston in a production position.

Referring to FIG. 7, as piston 14 slides into the production position, tapered lower end 30 contacts and pivots flapper valves 18 and 20 about pivot points 22 and 24, respectively, from the closed position (shown in FIG. 6) to the open position (shown in FIG. 7). In the milling position the piston is disposed above the flapper valves, and in the production position the piston is disposed through the flapper valves to secure the flapper valves in the open position. Piston 14 may be aligned within central bore 16 of production housing 12 such that lowest point 68 of tapered lower end 30 is positioned furthest from pivot points 22 and 24. In this way, lowest point 68 of tapered lower end 30 of piston 14 engages flapper valve 18 at a point furthest from pivot point 22, thereby reducing the force necessary to open flapper valve 18 and preventing any jamming of flapper valve 18. Similarly, lowest point 68 of tapered lower end 30 of piston 14 engages flapper valve 20 at a point furthest from pivot point 24, thereby reducing the force necessary to open flapper valve 20 and preventing any jamming of flapper valve 20. In the production position, piston 14 holds flapper valves 18 and 20 in the open position. Additionally, in the production position, piston 14 opens passages 36 through production housing 12 such that a fluid in a subterranean formation surrounding production housing 12 may flow into central bore 16 of production housing 12 and upstream for collection.

Figure 8:
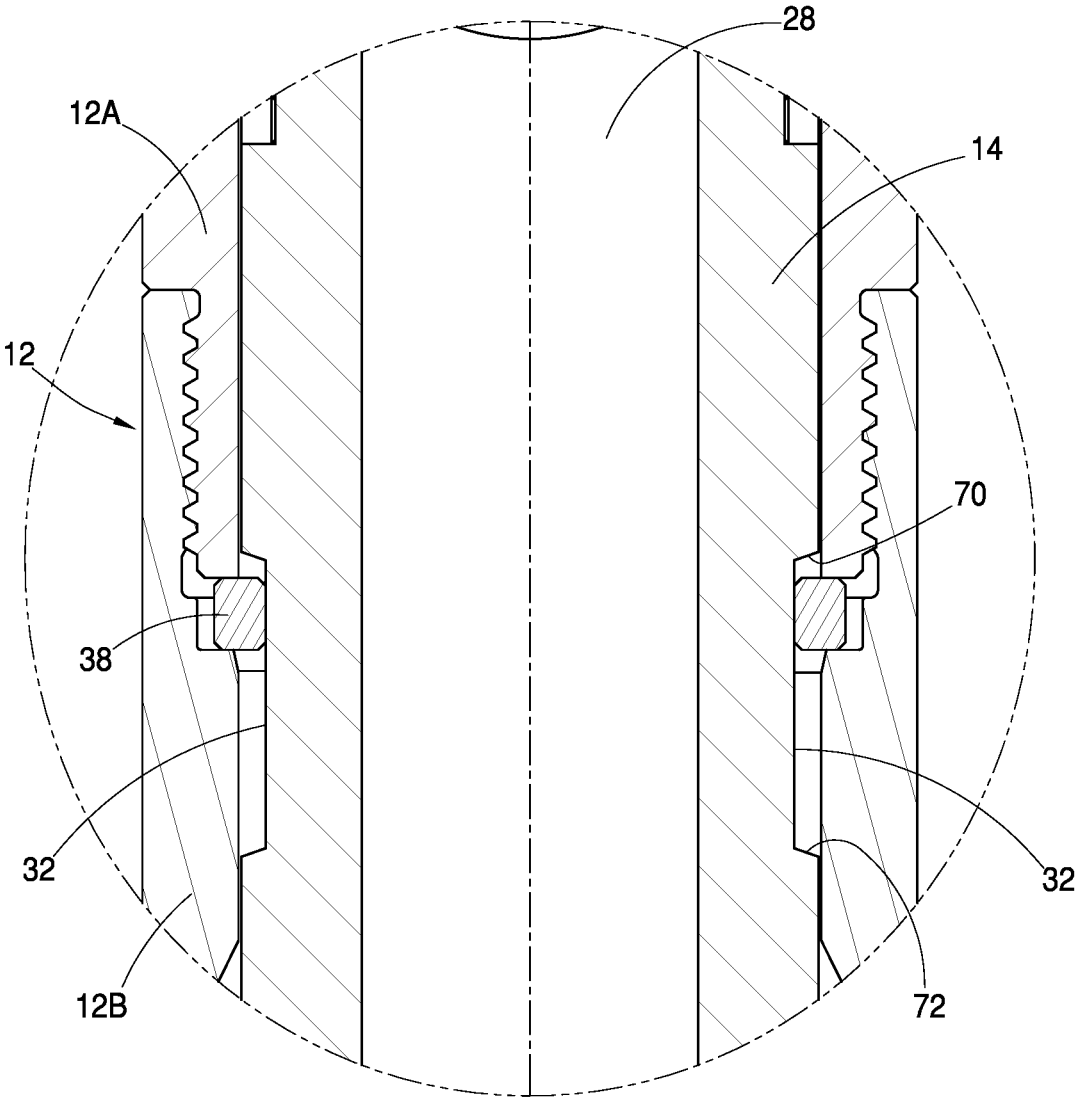
FIG. 8 is a partial sectional view of a snap ring engaging a recess in an outer surface of the piston as shown encircled as "8" in FIG. 7.

With reference to FIGS. 7 and 8, recess 32 of piston 14 may be aligned with snap ring 38 in the production position, such that snap ring 38 retracts into recess 32 (i.e., snap ring 38 moves inwardly). Because snap ring 38 is held in the space within production housing 12, such as a space between segments 12A and 12B, snap ring 38 and recess 32 may lock piston 14 in the production position within production housing 12. In other words, snap ring 38 is axially secured within production housing 12, and snap ring 38 engages upper shoulder 70 and/or lower shoulder 72 of recess 32 in piston 14 to prevent piston 14 from sliding out of the production position.

Figure 9:
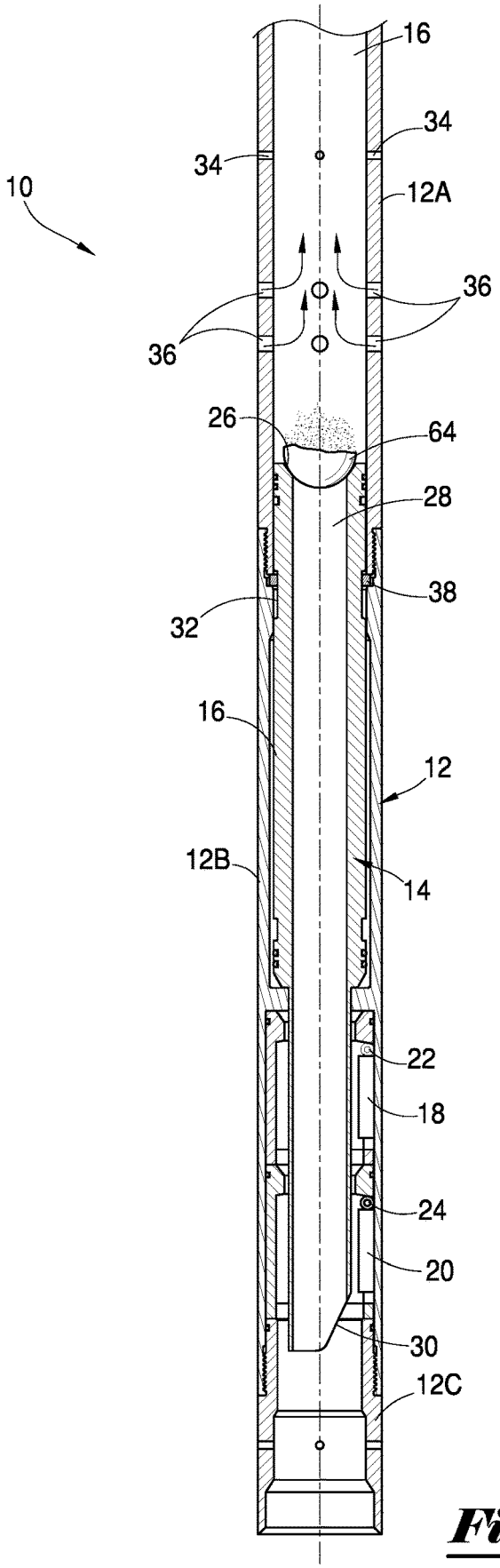
FIG. 9 is a sectional view of the milling and production device showing the ball dissolving.

As shown in FIG. 9, ball 64 may dissolve, decompose, or otherwise break down after a predetermined time period of exposure to a fluid, such as about 1 to about 48 hours, or about 2 to about 6 hours, or any subrange(s) therein. Ball 64 may be formed of magnesium, dissolvable rubber, and/or dissolvable polymers.

Figure 10:
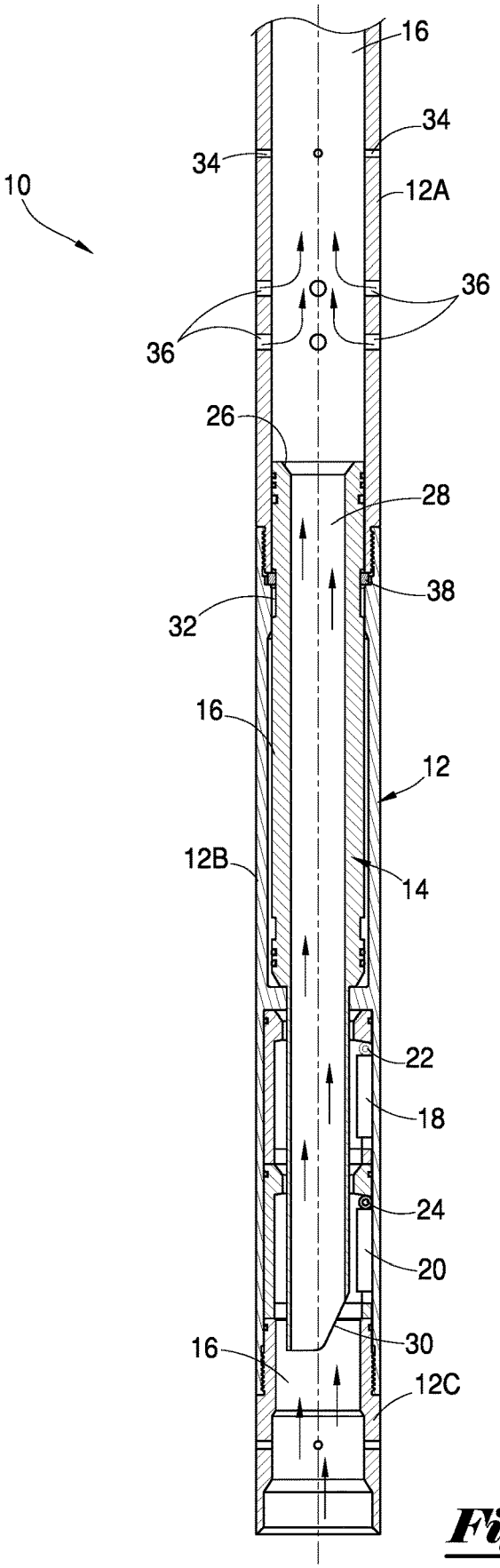
FIG. 10 is a sectional view of the milling and production device after the ball dissolves.

Referring now to FIG. 10, after ball 64 is removed from seat surface 26 of piston 14, a fluid disposed below a lower end of production housing 12 may flow up through central bore 16 of production housing 12, through central bore 28 of piston 14, and upstream for collection. Flapper valves 18 and 20 thereafter remain permanently in the open position. In this way, the integrated milling and production device 10 may be used for milling one or more bridge plugs in a wellbore and for production with only a single trip into the wellbore.

Figure 11:
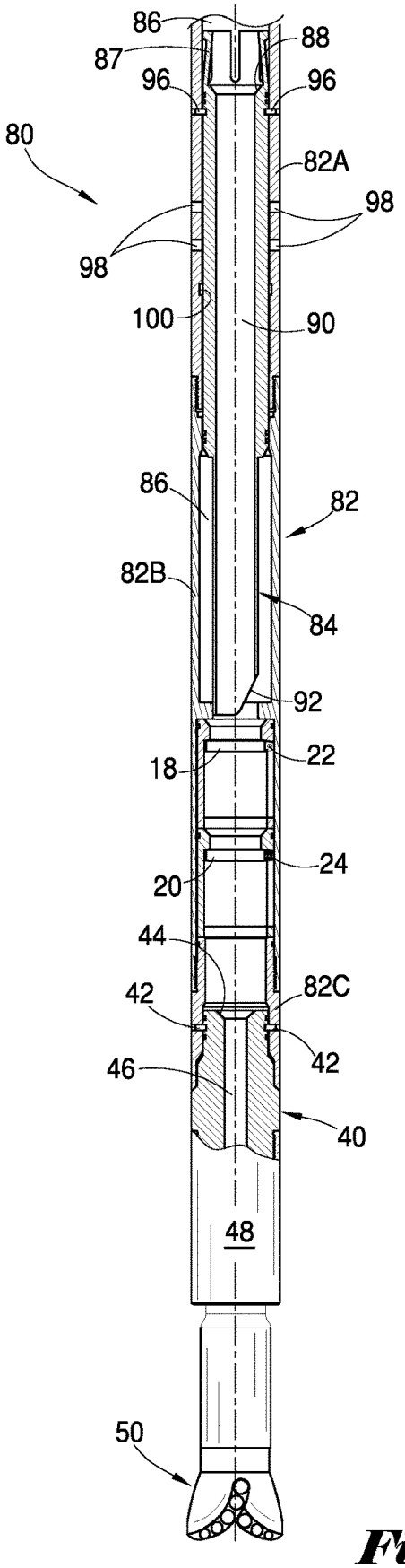
FIG. 11 is a partial sectional view of an alternate embodiment of the integrated milling and production device.
Figure 12:
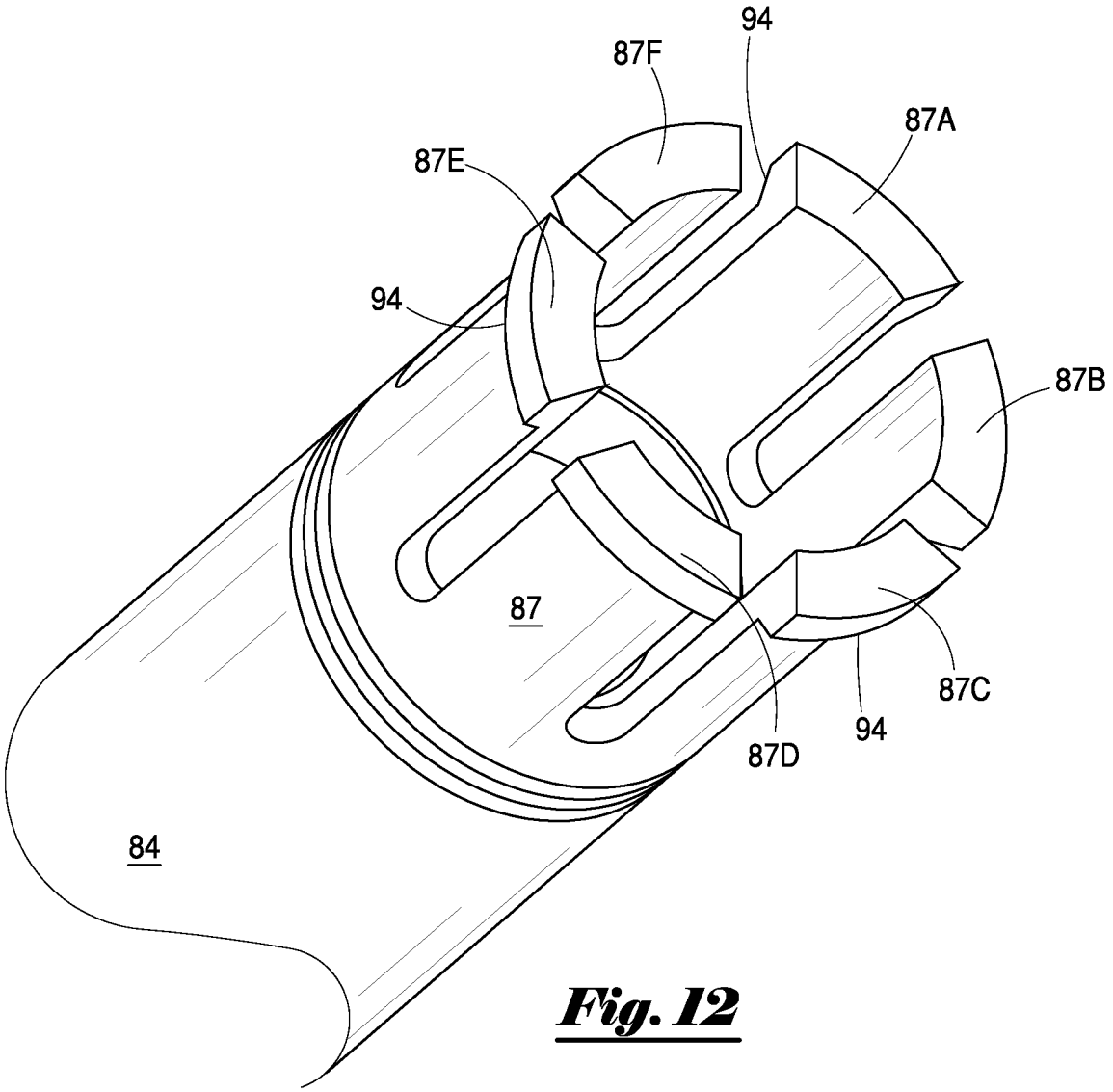
FIG. 12 is a partial perspective view of an upper end of a piston of the milling and production device of FIG. 11.

FIG. 11 illustrates integrated milling and production device 80. Except as otherwise noted, device 80 and each of its components have the same design and include the same features as device 10 and each of its components. Milling and production device 80 may include production housing 82 formed of one or more segments, such as 82A, 82B, and 82C. Milling and production device 80 may also include piston 84 disposed within central bore 86 of production housing 82. One or more flapper valves, such as flapper valves 18 and 20, may be pivotally disposed within central bore 86 of production housing 82. Flapper valves 18 and 20 are configured for pivotal motion about pivot points 22 and 24, respectively. In one embodiment, each of flapper valves 18 and 20 is biased toward a closed position by a spring that engages the flapper valve. The upper end of piston 84 may include collet section 87 extending to seat surface 88. Piston central bore 90 may extend from seat surface 88 to tapered lower end 92. As shown in FIG. 12, collet section 87 may include collets 87A-87F separated from one another by spaces, with each collet 87A-87F include an outer shoulder 94. In FIG. 11, piston 84 is secured in the milling position by shear pins 96, which are disposed through aligned recesses in production housing 82 and piston 84. In one embodiment, shear pins 96 may be formed of set screws. Production housing 82 may include one or more passages 98 extending from an outer surface to central bore 86 of production housing 82. Production housing 82 may further include recess 100 in an inner surface of central bore 86 of production housing 82. Integrated milling and production device 80 further includes connector 40, motor 48, and milling bit 50. Connector 40 may be secured to production housing 82 with shear pins 42. As with device 10, device 80 may be introduced into a wellbore using coiled tubing or a drill string. In both processes, milling bit 50 may be used to mill one or more bridge plugs in wellbore 52 to prepare wellbore 52 for production. When milling operations are complete, integrated milling and production device 80 may be transferred to a downhole position within the wellbore.

Figure 13:
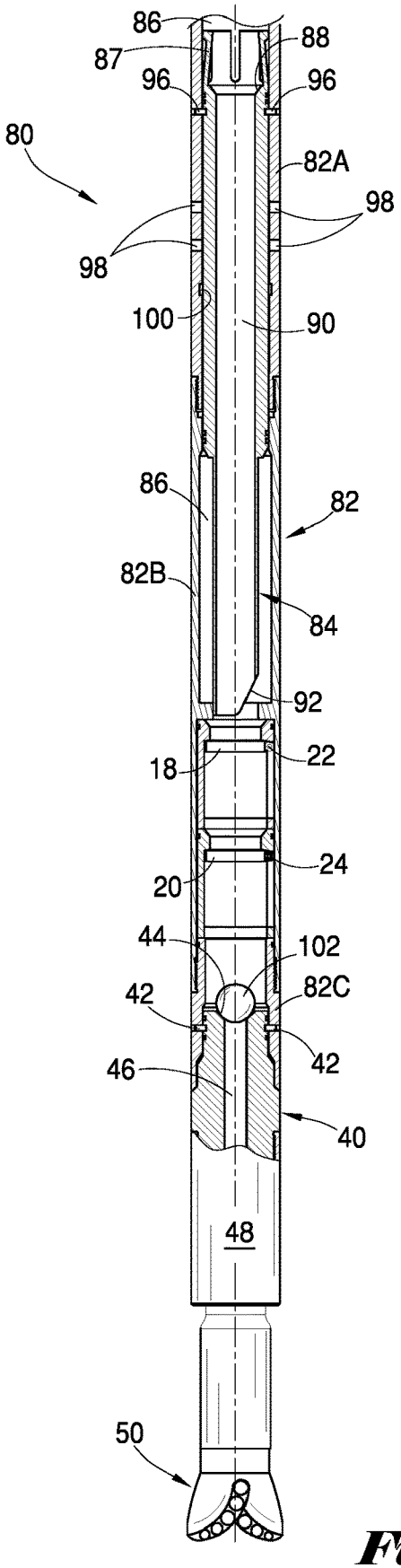
FIG. 13 is a partial sectional view of the milling and production device of FIG. 11 with a ball engaging a seat surface of a connector.
Figure 14:
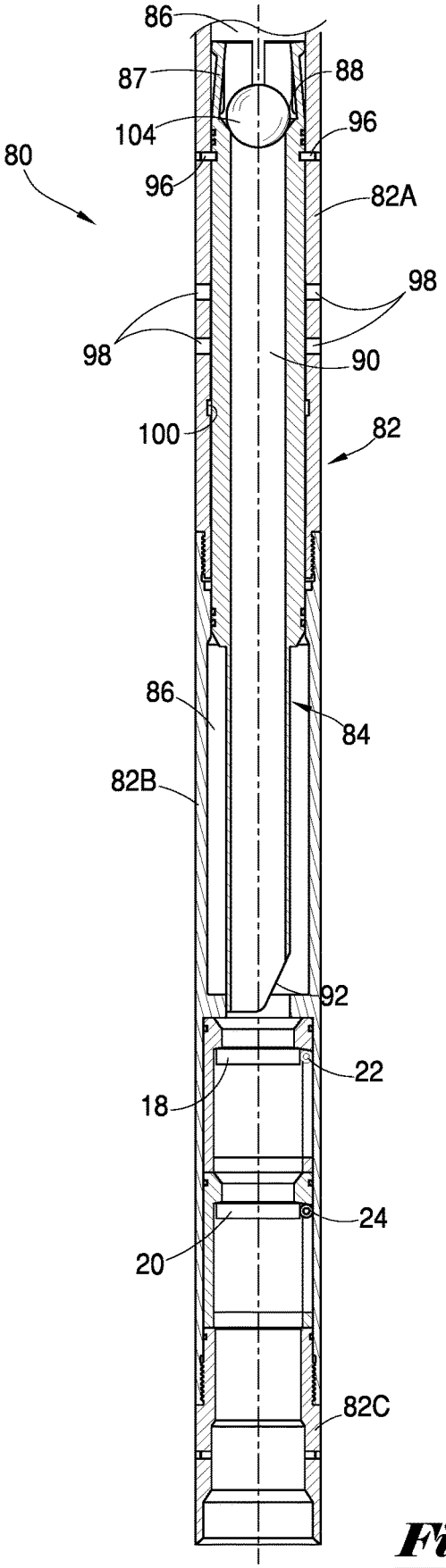
FIG. 14 is a sectional view of the milling and production device shown in FIG. 11 after the connector is activated by the ball, and with a ball engaging a seat surface of a piston.

With reference to FIG. 13, with device 80 in the downhole position, a user may insert ball 102 from the surface through the coiled tubing or drill string. Ball 102 may travel through central bore 86 of production housing 82, central bore 90 of piston 84, and flapper valves 18 and 20 before engaging seat surface 44 of connector 40. When ball 102 engages seat surface 44, ball 102 fluidly seals off central bore 46 of connector 40. Continued fluid flow into central bore 86 of production housing 82 builds pressure on ball 102 and the upper end of connector 40 until shear pins 42 are sheared, thereby disconnecting connector 40 from production housing 82 as shown in FIG. 14. In this way, ball 102 may be used to activate connector 40 to disconnect connector 40 from production housing 82. Connector 40 along with motor 48 and milling bit 50 may remain in the downhole position within the wellbore while production housing 82 may be displaced upstream within the wellbore, thereby separating the respective portions of integrated milling and production device 80 without removing any portion of device 10 from the wellbore. Ball 102 may be formed of steel, of a ceramic material, of a rubber, or of a polymer.

With reference now to FIG. 14, flapper valves 18 and 20 may remain in the closed position as production housing 82 is repositioned within the wellbore. Piston 84 may then be activated with ball 104. When production housing 82 is positioned in a production zone of the wellbore, a user may insert ball 104 from the surface through the coiled tubing or drill string. Ball 104 may enter central bore 86 of production housing 82 and engage seat surface 88 of piston 84. When ball 104 engages seat surface 88 of piston 84, ball 104 fluidly seals off central bore 90 of piston 84. Continued fluid flow into central bore 86 of production housing 82 builds pressure on ball 104 and the upper end of piston 84 until shear pins 96 are sheared, thereby allowing piston 84 from the milling position shown in FIG. 14 to the production position shown in FIG. 15.

Figure 15:
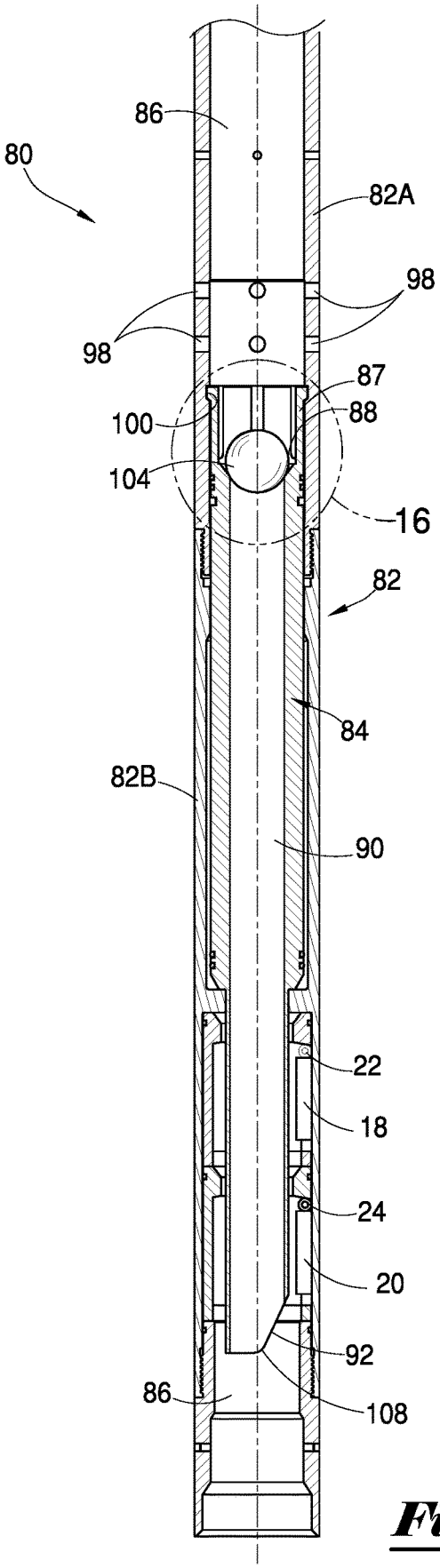
FIG. 15 is a sectional view of the milling and production device of FIG. 11 with the piston in a production position.

Referring to FIG. 15, as piston 84 slides into the production position, tapered lower end 92 contacts and pivots flapper valves 18 and 20 about pivot points 22 and 24, respectively, from the closed position (shown in FIG. 14) to the open position (shown in FIG. 15). Piston 84 may be aligned within central bore 86 of production housing 82 such that lowest point 108 of tapered lower end 92 is positioned furthest from pivot points 22 and 24 and engages flapper valves 18 and 20 at a point furthest from pivot points 22 and 24 first. This prevents jamming and reduces the force required to open flapper valves 18 and 20. Additionally, in the production position, piston 84 opens passages 98 such that a fluid in a subterranean formation surrounding production housing 82 may flow through passages 98 into central bore 86 of production housing 82 and upstream for collection.

Figure 16:
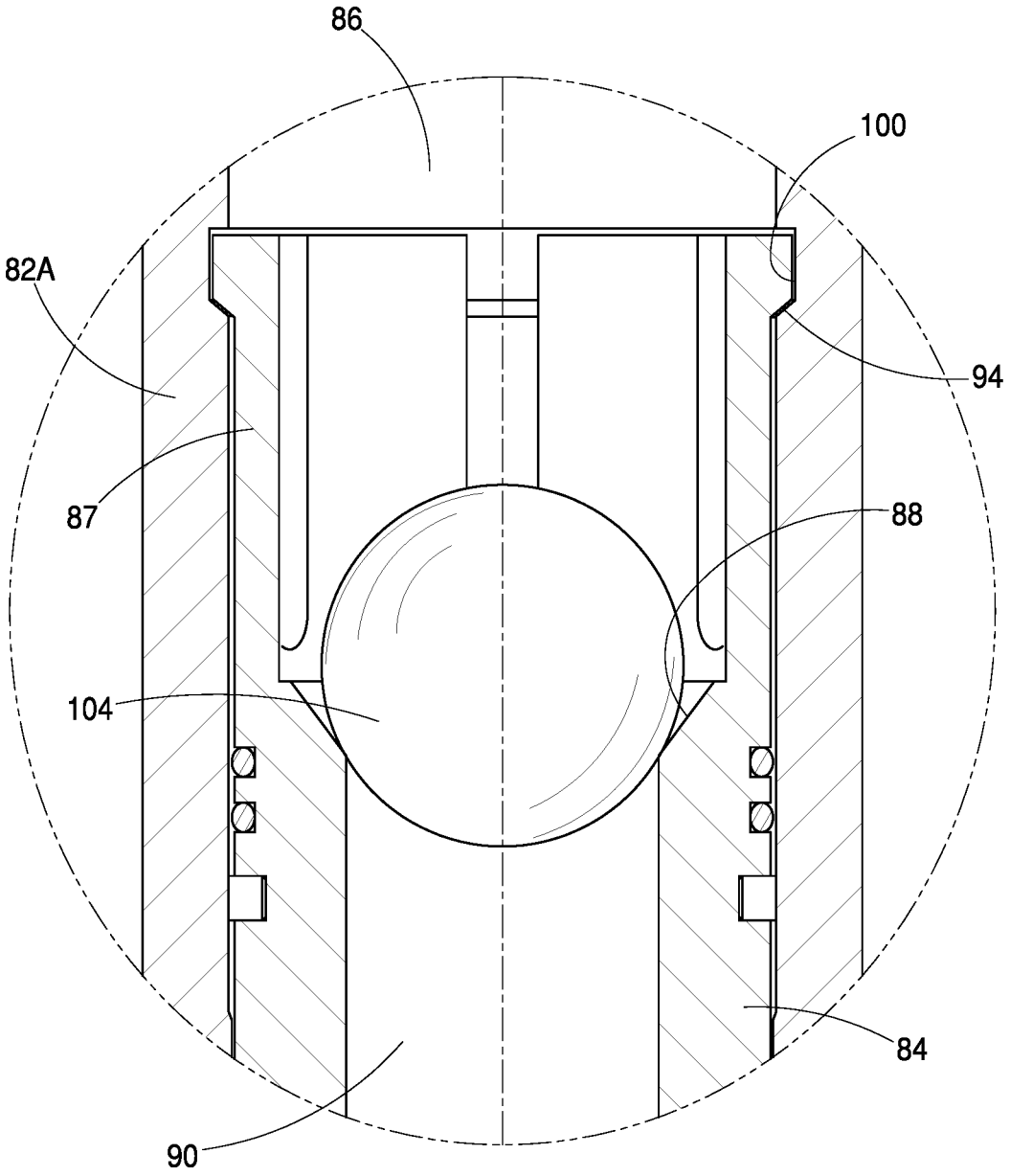
FIG. 16 is a partial sectional view showing an outer shoulder of a collet section of the piston engaging a recess in an inner surface of a production housing as shown encircled as "16" in FIG. 15.

With reference to FIGS. 15 and 16, outer shoulder 94 of collet section 87 of piston 84 engages recess 100 of production housing 82 to lock piston 84 in the production position within production housing 12.

Figure 17:
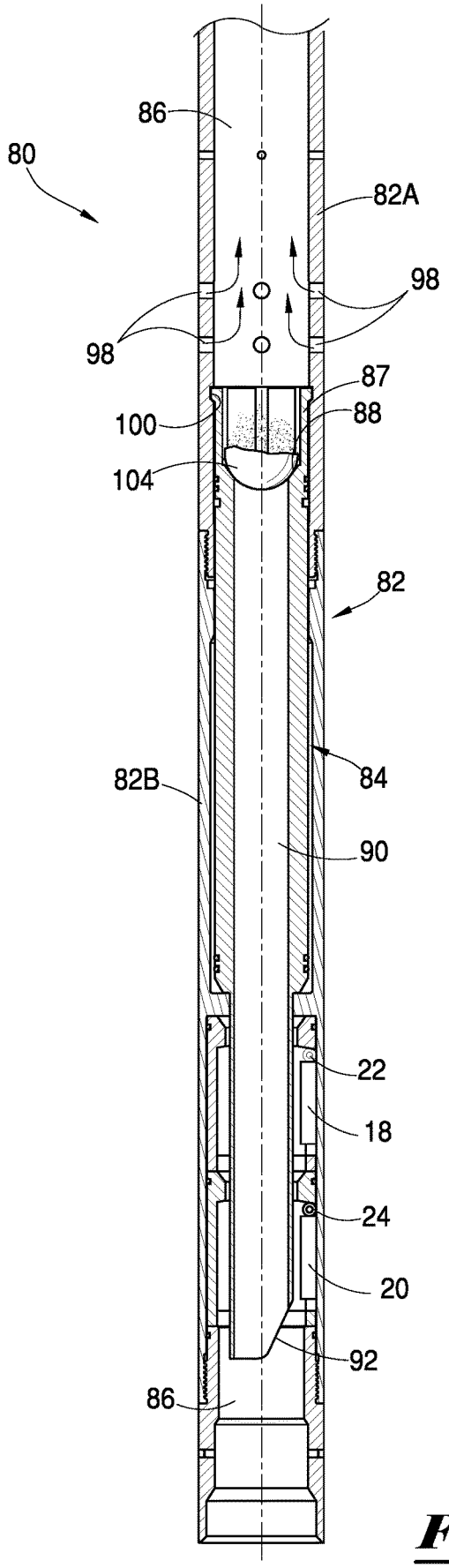
FIG. 17 is a sectional view of the milling and production device of FIG. 11 showing the ball dissolving.

As shown in FIG. 17, ball 104 may dissolve, decompose, or otherwise break down after a predetermined time period of exposure to a fluid, such as about 1 to about 48 hours, or about 2 to about 6 hours, or any subrange(s) therein. Ball 104 may be formed of magnesium, dissolvable rubber, and/or dissolvable polymers.

Figure 18:
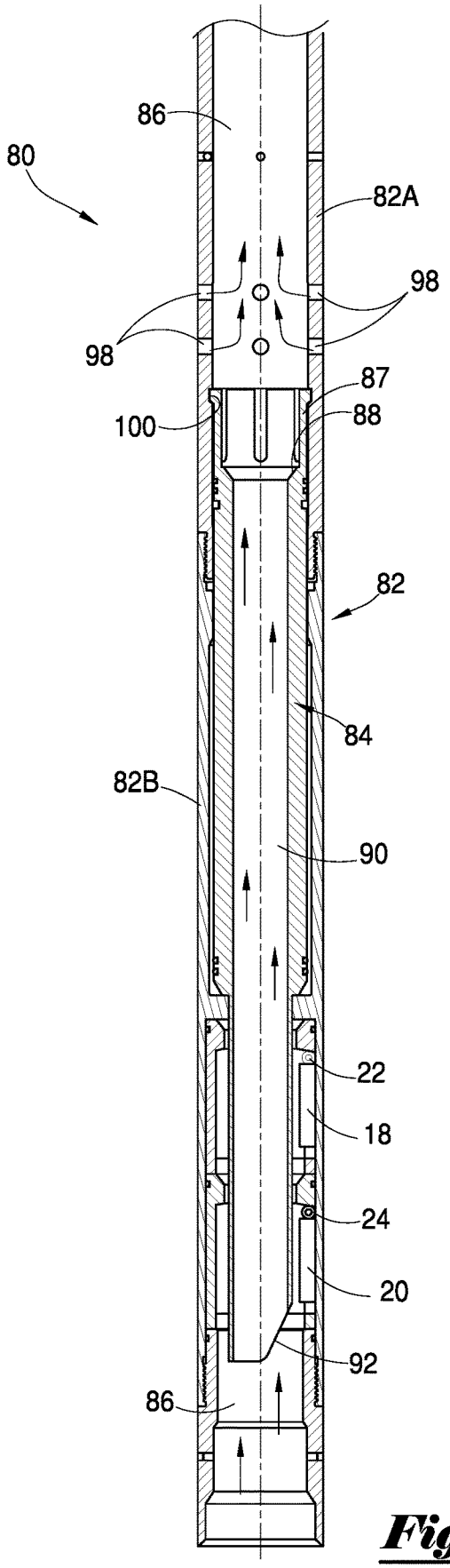
FIG. 18 is a sectional view of the milling and production device of FIG. 11 after the ball dissolves.

Referring now to FIG. 18, after ball 104 is removed from seat surface 88 of piston 84, a fluid disposed below a lower end of production housing 82 may flow up through central bore 86 of production housing 82, through central bore 90 of piston 84, and upstream for collection. Flapper valves 18 and 20 remain permanently in the open position. In this way, the integrated milling and production device 80 may be used for milling one or more bridge plugs in a wellbore and for production with only a single trip into the wellbore.

Figure 19:
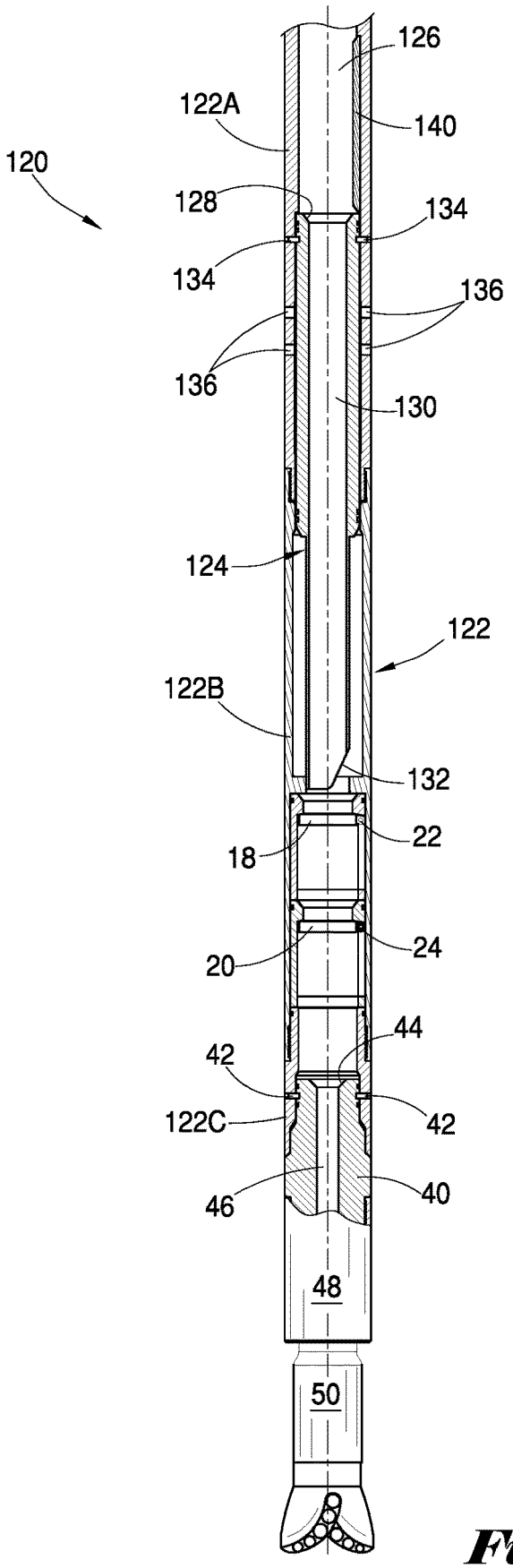
FIG. 19 is a partial sectional view of a second alternate embodiment of an integrated milling and production device.

FIG. 19 illustrates integrated milling and production device 120. Except as otherwise noted, device 120 and each of its components have the same design and include the same features as device 10 and each of its components. Milling and production device 120 may include production housing 122 formed of one or more segments, such as 122A, 122B, and 122C. Piston 124 is disposed within central bore 126 of production housing 122. An upper end of piston 124 includes seat surface 128 and piston central bore 130 extending from seat surface 128 to tapered lower end 132. In FIG. 19, piston 124 is secured in the milling position by shear pins 134, which are disposed through aligned recesses in production housing 122 and piston 124. In one embodiment, shear pins 134 may be formed of set screws. Production housing 122 may include one or more passages 136 extending from an outer surface to central bore 126. One or more flapper valves, such as flapper valves 18 and 20, may be pivotally disposed within central bore 126 of production housing 122. Flapper valves 18 and 20 are configured for pivotal motion about pivot points 22 and 24, respectively. In one embodiment, each of flapper valves 18 and 20 is biased toward a closed position by a spring that engages the flapper valve. Integrated milling and production device 120 may further include actuating fixture 140 disposed in central bore 126 of production housing 122. Actuating fixture 140 may be positioned above the upper end of piston 124.

Integrated milling and production device 120 may further include connector 40, motor 48, and milling bit 50. Connector 40 may be secured below production housing 122 with shear pins 42. As with assemblies 10 and 80, device 120 may be introduced into a wellbore using coiled tubing or a drill string. In both processes, milling bit 50 may be used to mill one or more bridge plugs in wellbore 52 to prepare wellbore 52 for production. When milling operations are complete, integrated milling and production device 120 may be transferred to a downhole position within the wellbore.

Figure 20:
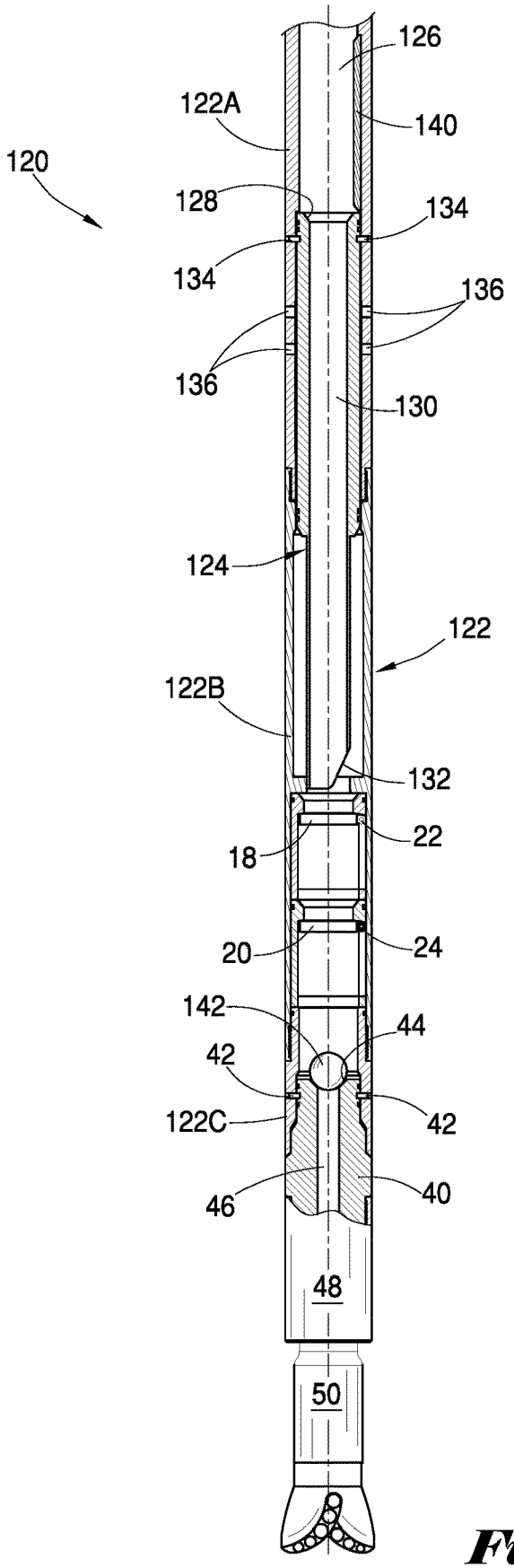
FIG. 20 is a partial sectional view of the milling and production device of FIG. 19 with a ball engaging a seat surface of a connector.
Figure 21:
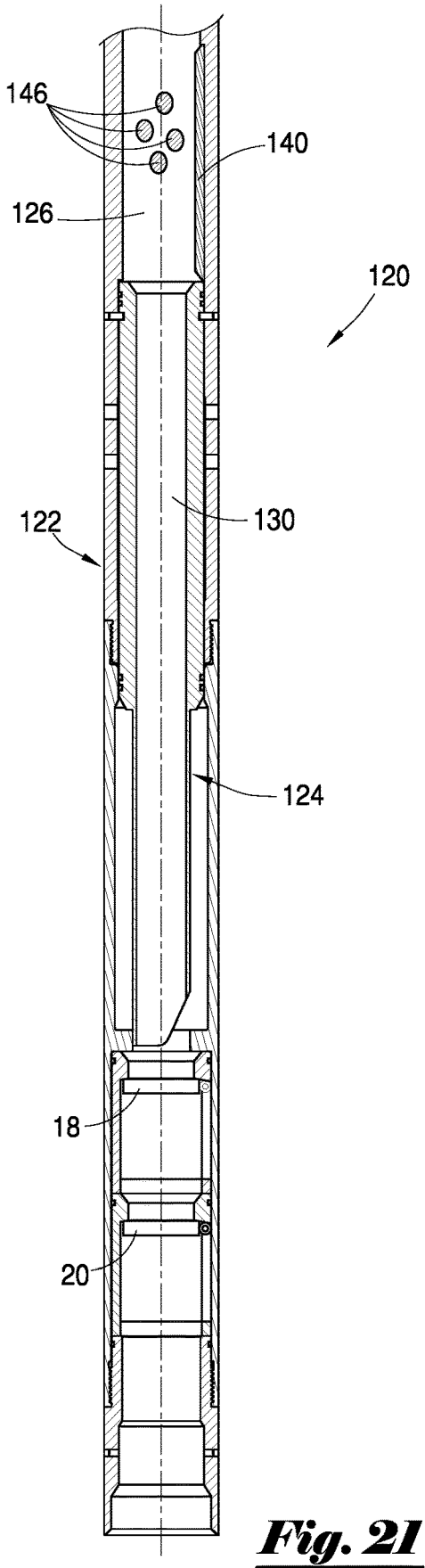
FIG. 21 is a sectional view of the milling and production device of FIG. 19 after the connector is activated by the ball, and with signal objects in proximity to an actuating fixture.

With reference to FIG. 20, with device 120 in the downhole position, a user may insert ball 142 from the surface through the coiled tubing or drill string. Ball 142 may travel through central bore 126 of production housing 122, central bore 130 of piston 124, and flapper valves 18 and 20 before engaging seat surface 44 of connector 40. With ball 142 sealing off central bore 46 of connector 40, continued fluid flow into central bore 126 of production housing 122 builds pressure on ball 142 and the upper end of connector 40 until shear pins 42 are sheared, thereby disconnecting connector 40 from production housing 122 as shown in FIG. 21. In this way, ball 142 may be used to activate connector 40 to disconnect connector 40 from production housing 122. Connector 40 along with motor 48 and milling bit 50 may remain in the downhole position within the wellbore while production housing 122 may be displaced upstream within the wellbore, thereby separating the respective portions of integrated milling and production device 120 without removing any portion of device 120 from the wellbore. Ball 142 may be formed of steel, a ceramic material, a rubber, or a polymer.

With reference now to FIG. 21, as production housing 122 is repositioned within the wellbore, flapper valves 18 and 20 may remain in the closed position to prevent any fluid surrounding or below production housing 122 from entering central bore 126. Piston 124 may then be activated with signal objects 146. In one embodiment, signal objects 146 may be formed of radio frequency identification constructs. When production housing 122 is positioned in a production zone of the wellbore, a user may insert signal objects 146 from the surface through the coiled tubing or drill string. Signal objects 146 may enter central bore 126 of production housing and travel past actuating fixture 140, which may include a sensor configured to detect the presence of signal objects 146 in proximity to the sensor. When the sensor of actuating fixture 140 detects signal objects 146, actuating fixture 140 may transfer piston 124 from the milling position (shown in FIG. 21) to the production position (shown in FIG. 22). In one embodiment, actuating fixture 140 may include an extendable arm having a lower end secured to an upper end of piston 124. In this embodiment, actuating fixture 140 may extend the extendable arm until shear pins 134 are sheared, thereby allowing piston 124 to slide into the production position with further extension of the extendable arm.

In an alternate embodiment, an umbilical line is provided and connected to the actuating fixture to provide a signal from a user at surface 54 to slide piston 124 from the milling position to the production position. The umbilical line may also provide the energy required to slide piston 124 from the milling position to the production position. For example, the umbilical line may provide a hydraulic signal or an electric signal.

Figure 22:
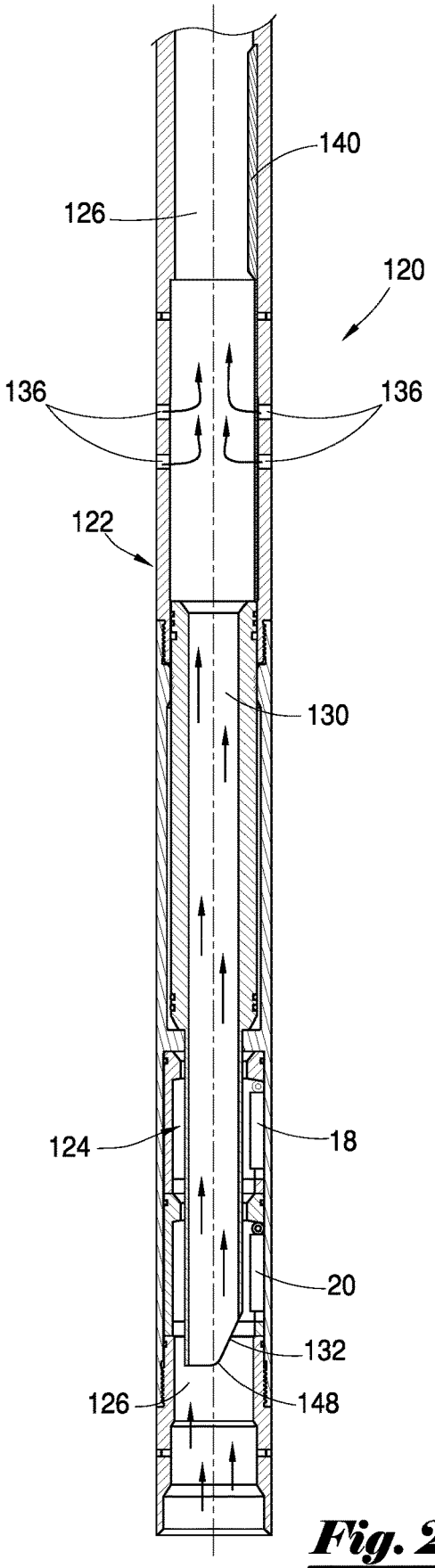
FIG. 22 is a sectional view of the milling and production device of FIG. 19 with a piston in a production position.

Referring to FIG. 22, as piston 124 slides into the production position, tapered lower end 132 contacts and pivots flapper valves 18 and 20 about pivot points 22 and 24, respectively, from the closed position (shown in FIG. 21) to the open position (shown in FIG. 22). Piston 124 may be aligned within central bore 126 of production housing 122 such that lowest point 148 of tapered lower end 132 is positioned furthest from pivot points 22 and 24 and first engages flapper valves 18 and 20 at a point furthest from pivot points 22 and 24, thereby preventing jamming and reducing the force required to open flapper valves 18 and 20. With flapper valves 18 and 20 in the open position as shown in FIG. 22, a fluid disposed below a lower end of production housing 122 may flow up through central bore 126 of production housing 122, through central bore 130 of piston 124, and upstream for collection. Flapper valves 18 and 20 remain permanently in the open position. Additionally, in the production position, piston 124 opens passages 136 such that a fluid in a subterranean formation surrounding production housing 122 may flow through passages 136 into central bore 126 of production housing 122 and upstream for collection. In this way, integrated milling and production device 120 may be used for milling one or more bridge plugs in a wellbore and for production with only a single trip into the wellbore.

Except as otherwise described or illustrated, each of the components in this device has a generally cylindrical shape and may be formed of steel, another metal, or any other durable material. Each device described in this disclosure may include any combination of the described components, features, and/or functions of each of the individual device embodiments. Each method described in this disclosure may include any combination of the described steps in any order, including the absence of certain described steps and combinations of steps used in separate embodiments. Any range of numeric values disclosed herein includes any subrange therein. Plurality means two or more. "Above" and "below" shall each be construed to mean upstream and downstream, such that the directional orientation of the device is not limited to a vertical arrangement.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

We claim:

1. An integrated milling and production device comprising:

a production housing including a central bore and one or more passages extending from an outer surface to the central bore, the production housing having an upper end and a lower end;

one or more flapper valves pivotally disposed within the central bore of the production housing;

an actuator disposed within the central bore of the production housing, the actuator configured to permanently open the one or more flapper valves and the one or more passages of the production housing when activated;

a connector having an upper end and a lower end, the upper end of the connector selectively secured to the lower end of the production housing, the connector configured to disconnect from the production housing when activated;

a motor secured to the lower end of the connector; and a milling bit operatively secured to the motor;

wherein in a closed position each of the flapper valves seals the central bore of the production housing, and wherein in an open position each of the flapper valves allows for fluid flow through the central bore of the production housing;

wherein the actuator is a piston disposed within the central bore of the production housing, wherein in a milling position the piston is disposed above the one or more flappers, and wherein in a production position the piston is disposed through the one or more flapper valves to secure the one or more flapper valves in the open position.

2. The integrated milling and production device of claim 1, wherein the upper end of the connector is secured to the lower end of the production housing with one or more shear pins, wherein the connector includes a central bore and a connector seat surface configured to receive a ball, and wherein the connector is activated when a ball engages the connector seat surface, closes the central bore of the connector, and increases a fluid pressure to shear the one or more shear pins and disconnect the connector from the production housing.

3. The integrated milling and production device of claim 1, wherein the one or more flapper valves is each biased toward the closed position by a spring.

4. The integrated milling and production device of claim 1, wherein the piston includes a tapered lower end such that the piston first contacts a portion of each flapper valve that is opposite a pivot point of the flapper valve.

5. The integrated milling and production device of claim 1, wherein in the milling position the piston closes the one or more passages in the production housing, and wherein in the production position the piston opens the one or more passages in the production housing to allow fluid flow through the one or more passages into the central bore of the production housing.

6. The integrated milling and production device of claim 1, further comprising one or more shear pins securing the piston to the production housing in the milling position, wherein an upper end of the piston includes a piston seat surface configured to receive a ball, and wherein the piston is activated when a ball engages the piston seat surface to shear the one or more shear pins and slide the piston from the milling position to the production position.

7. The integrated milling and production device of claim 6, further comprising a snap ring secured within a space in the central bore of the production housing in the milling position, wherein the snap ring is configured to engage a recess in an outer surface of the piston in the production position to lock the piston in the production position.

8. The integrated milling and production device of claim 6, wherein the upper end of the piston further includes a collet section including a series of fingers each having an upper shoulder, wherein the upper shoulders are configured to engage a recess in an inner surface of the production housing in the production position to lock the piston in the production position.

9. The integrated milling and production device of claim 1, wherein the actuator further includes an actuating fixture disposed within the central bore of the production housing, wherein the actuating fixture is configured to slide the piston from the milling position to the production position.

10. The integrated milling and production device of claim 9, further comprising an umbilical line connected to the actuating fixture to provide a signal and energy to slide the piston from the milling position to the production position.

11. The integrated milling and production device of claim 9, wherein the actuating fixture includes a sensor configured to detect the presence of one or more signal objects in proximity to the sensor, and wherein the actuating fixture slides the piston from the milling position to the production position when the sensor detects the signal objects.

12. The integrated milling and production device of claim 1, wherein the actuator includes an actuating fixture disposed within the central bore of the production housing.

13. The integrated milling and production device of claim 12, further comprising an umbilical line connected to the actuating fixture to provide a signal to open or close the one or more flapper valves.

14. The integrated milling and production device of claim 12, wherein the actuating fixture includes a sensor configured to detect the presence of one or more signal objects in proximity to the sensor, and wherein the actuating fixture opens or closes the one or more flapper valves when the sensor detects the signal objects.

* * * * *